US011447721B2

(12) United States Patent
Billiauw et al.

(10) Patent No.: US 11,447,721 B2
(45) Date of Patent: Sep. 20, 2022

(54) LIQUID HAND DISHWASHING CLEANING COMPOSITION

(71) Applicant: The Procter & Gamble Company, Cincinnati, OH (US)

(72) Inventors: Jan Julien Marie-Louise Billiauw, Gentbrugge (BE); Roel Krols, Antwerp (BE); Christopher Stephen Jones, St. Gilles (BE)

(73) Assignee: The Procter & Gamble Company, Cincinnati, OH (US)

( * ) Notice: Subject to any disclaimer, the term of this patent is extended or adjusted under 35 U.S.C. 154(b) by 88 days.

(21) Appl. No.: 16/774,012

(22) Filed: Jan. 28, 2020

(65) Prior Publication Data

US 2020/0157468 A1 May 21, 2020

Related U.S. Application Data

(63) Continuation of application No. PCT/US2018/049435, filed on Sep. 5, 2018.

(30) Foreign Application Priority Data

Sep. 15, 2017 (EP) ..... 17191360

(51) Int. Cl.

| | |
|---|---|
| ***C11D 1/29*** | (2006.01) |
| ***C11D 1/75*** | (2006.01) |
| ***C11D 3/30*** | (2006.01) |
| ***C11D 1/14*** | (2006.01) |
| ***C11D 3/04*** | (2006.01) |
| ***C11D 3/22*** | (2006.01) |
| ***C11D 3/37*** | (2006.01) |
| ***C11D 3/43*** | (2006.01) |
| ***C11D 1/90*** | (2006.01) |
| ***C11D 1/72*** | (2006.01) |
| ***C11D 1/722*** | (2006.01) |
| ***C11D 1/94*** | (2006.01) |
| ***C11D 3/33*** | (2006.01) |
| ***C11D 3/20*** | (2006.01) |

(52) U.S. Cl.

CPC ..... *C11D 1/146* (2013.01); *C11D 1/14* (2013.01); *C11D 1/29* (2013.01); *C11D 1/72* (2013.01); *C11D 1/722* (2013.01); *C11D 1/75* (2013.01); *C11D 1/90* (2013.01); *C11D 1/94* (2013.01); *C11D 3/046* (2013.01); *C11D 3/2006* (2013.01); *C11D 3/2041* (2013.01); *C11D 3/222* (2013.01); *C11D 3/30* (2013.01); *C11D 3/33* (2013.01); *C11D 3/3723* (2013.01); *C11D 3/3796* (2013.01); *C11D 3/43* (2013.01)

(58) Field of Classification Search

CPC .... C11D 1/14; C11D 1/29; C11D 1/72; C11D 1/722; C11D 1/75; C11D 1/90; C11D 1/94; C11D 3/30; C11D 3/33; C11D 3/3723; C11D 3/2041; C11D 3/2006

USPC ..... 510/235, 237, 475, 499, 505, 506

See application file for complete search history.

(56) References Cited

U.S. PATENT DOCUMENTS

| | | | | |
|---|---|---|---|---|
| 9,493,726 | B2 | 11/2016 | Vinson et al. | |
| 2009/0014029 | A1* | 1/2009 | Borne | C11D 3/3723 134/6 |
| 2013/0196890 | A1* | 8/2013 | Post | C11D 3/042 510/109 |
| 2013/0303426 | A1* | 11/2013 | Scialla | C11D 3/3723 510/235 |
| 2016/0068784 | A1 | 3/2016 | Vinson et al. | |
| 2017/0121655 | A1 | 5/2017 | Delplancke | |
| 2017/0137747 | A1 | 5/2017 | Tang | |
| 2017/0313957 | A1 | 11/2017 | Keuleers et al. | |
| 2018/0201875 | A1 | 7/2018 | Stenger et al. | |
| 2020/0157469 | A1 | 5/2020 | Billiauw | |

FOREIGN PATENT DOCUMENTS

| | | | |
|---|---|---|---|
| EP | 2264136 | A1 | 12/2010 |
| EP | 2757144 | A1 | 7/2014 |
| EP | 3243895 | A1 | 11/2017 |
| WO | WO9739089 | A1 | 10/1997 |
| WO | WO9919440 | A1 | 4/1999 |
| WO | WO0244312 | A2 | 6/2002 |
| WO | WO2017079960 | A1 | 5/2017 |
| WO | WO2018017335 | A1 | 11/2017 |

OTHER PUBLICATIONS

CM4864 EPO Search Report; Application No. 17191360.1-1105; dated Mar. 22, 2018; 11 pages.

International Search Report and Written Opinion; Application Ser. No. PCT/US2018/049435; dated Nov. 28, 2018, 16 pages.

All Office Actions; U.S. Appl. No. 16/774,017, filed Jan. 28, 2020.

* cited by examiner

*Primary Examiner* — Gregory R Delcotto

(74) *Attorney, Agent, or Firm* — Carolyn S. Powell; Carrie Schwartz

(57) ABSTRACT

The present invention relates to a hand dishwashing cleaning composition including a surfactant system, wherein the surfactant system includes an anionic surfactant and a co-surfactant, wherein the anionic surfactant includes a mixture of a linear anionic surfactant and a branched anionic surfactant with a defined degree of branching on an alkyl ethoxy sulfate surfactant. Such compositions exhibit surprising and unexpected improved sudsing profile, preferably stable suds, especially when the manual dishwashing is performed in a sink full of water with the cleaning composition diluted in it.

19 Claims, No Drawings

LIQUID HAND DISHWASHING CLEANING COMPOSITION

FIELD OF THE INVENTION

The present invention relates to a liquid hand dishwashing cleaning composition comprising a surfactant system comprising an anionic surfactant and a co-surfactant, wherein the anionic surfactant is selected from a mixture of a linear anionic surfactant and a branched anionic surfactant with a defined degree of branching on branched alkyl sulfate and branched alkyl ethoxy sulfate surfactant. The composition provides good sudsing profile, in particular suds stabilization benefit in the presence of greasy and/or particulate soils. The composition also provides good cleaning of greasy and/or particulate soils.

BACKGROUND OF THE INVENTION

Traditionally, manual dishwashing is performed in a sink full of water with the cleaning composition diluted in it. Accordingly, with this method of hand dishwashing, the user relies on the sudsing profile as an indicator of the composition's cleaning ability. To qualify a dishwashing detergent as having a good sudsing profile, the generated foam must produce high suds volume and/or longevity (i.e., mileage) of the suds (i.e., stable suds), preferably with sustained suds aesthetics throughout dilution during the wash process (i.e., suds whiteness and consistency), to indicate to the user that sufficient active ingredients (e.g., surfactants) are present to perform the desired cleaning. Previous attempts to improve sudsing profile have not focused on the use of the defined mixture according to the invention of linear and branched anionic surfactant, wherein the branched anionic surfactant comprises a defined branching split between branched alkyl sulfate and branched alkyl ethoxy sulfate anionic surfactant, in particular to improve suds generation and/or suds stabilization in the presence of greasy and/or particulate soils.

Thus, the need remains for a cleaning composition having a good sudsing profile, in particular increased suds volume and/or increased suds stabilization benefits in the presence of greasy and/or particulate soils, particularly through-out the entire manual dishwashing operation. The need also exists for a cleaning composition, particularly a hand dishwashing cleaning composition, that sustains suds aesthetics throughout the dilution and the wash process, and provides good product dissolution and cleaning, particularly good cleaning of greasy and/or particulate soils. The Applicant has discovered that some or all of the above-mentioned needs can be at least partially fulfilled through cleaning compositions as described herein below.

SUMMARY OF THE INVENTION

The present invention meets one or more of these needs based on the surprising discovery that by formulating a cleaning composition having a surfactant system comprising an anionic surfactant selected from a mixture of a linear anionic surfactant and a branched anionic surfactant, with a defined degree of branching between a branched alkyl sulfate and a branched alkyl ethoxy sulfate surfactant, such a composition exhibits good sudsing profile, particularly desirable suds volume and sustained suds stabilization in the presence of greasy and/or particulate soils.

In one aspect, the present invention is directed to a liquid hand dishwashing cleaning composition comprising from 1% to 60%, preferably from 5% to 50%, more preferably from 8% to 45%, most preferably from 15% to 40%, by weight of the total composition of a surfactant system comprising an anionic surfactant and a co-surfactant. The anionic surfactant has an average alkyl chain length of from 8 to 18, preferably from 10 to 14, more preferably from 12 to 14, most preferably from 12 to 13 carbon atoms. The anionic surfactant has a weight average degree of branching of from 27% to 34%, preferably from 29% to 32%, and an average degree of ethoxylation of less than 5, preferably less than 3, more preferably less than 2 and more than 0.5, most preferably between 0.5 and 0.9. The anionic surfactant comprises an alkyl sulfate, an alkyl alkoxy sulfate preferably an alkyl ethoxy sulfate, or mixtures thereof, preferably the alkyl sulfate, the alkyl alkoxy sulfate preferably the alkyl ethoxy sulfate, or mixtures thereof is a mixture of linear anionic surfactant and branched anionic surfactant. The branched anionic surfactant is selected from 5% to 100%, preferably from 5% to 75%, more preferably from 5% to 60%, even more preferably from 5% to 45%, most preferably from 5% to 30% by weight of the total branched anionic surfactant of a branched alkyl ethoxy sulfate surfactant and from 0% to 95%, preferably from 25% to 95%, more preferably from 40% to 95%, even more preferably from 55% to 95%, most preferably from 70% to 95% by weight of the total branched anionic surfactant of a branched alkyl sulfate surfactant. The co-surfactant is selected from the group consisting of an amphoteric surfactant, a zwitterionic surfactant and mixtures thereof, preferably an amphoteric surfactant, more preferably an amine oxide surfactant. The weight ratio of the anionic surfactant to the co-surfactant is from 1:1 to 8:1, preferably from 2:1 to 5:1, more preferably from 2.5:1 to 4:1.

In another aspect, the present invention is directed to a liquid hand dishwashing cleaning composition comprising from 15% to 40% by weight of the total composition of a surfactant system comprising an anionic surfactant, and an amine oxide co-surfactant. The anionic surfactant has a weight average degree of branching of from 29% to 32%, and an average degree of ethoxylation of between 0.5 and 0.9. The anionic surfactant is selected from a mixture of a linear anionic and a branched anionic surfactant. The linear anionic surfactant is a mixture of a linear alkyl sulfate surfactant and a linear alkyl ethoxy sulfate surfactant. The branched anionic surfactant is a mixture of from 5% to 30% by weight of the total branched anionic surfactant of a branched alkyl ethoxy sulfate surfactant and from 70% to 95% by weight of the total branched anionic surfactant of a branched alkyl sulfate surfactant. The weight ratio of the anionic surfactant to the amine oxide co-surfactant is between 2.5:1 and 4:1.

According to another aspect of the invention there is provided a method of manually washing dishware using the composition of the invention. The method comprises the steps of: delivering a composition of the invention to a volume of water to form a wash solution and immersing the dishware in the solution.

There is also provided the use of the composition of the invention for the stabilization of suds in the presence of greasy and/or particulate soils.

It is an object of the composition of the present invention to exhibit good sudsing profile, preferably high suds volume and sustained suds aesthetics (i.e. whiteness and/or consistency) throughout dilution and the wash process.

It is an object of the composition of the present invention to exhibit good sudsing profile, preferably stable suds during a substantial portion of or for the entire manual dishwashing process.

It is an object of the composition to provide good product dissolution and cleaning, preferably good tough food cleaning (e.g., cooked-, baked- and burnt-on soils) and/or good grease and/or particulate soil cleaning.

These and other features, aspects and advantages of the present invention will become evident to those skilled in the art from the detailed description which follows.

DETAILED DESCRIPTION OF THE INVENTION

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of" and "consisting essentially of." The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (e.g., polyethylene, polypropylene, polystyrene, etc.) and wood.

The term "grease" or "greasy" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The term "particulate soils" as used herein means inorganic and especially organic, solid soil particles, especially food particles, such as for non-limiting examples: finely divided elemental carbon, baked grease particle, and meat particles.

The term "sudsing profile" as used herein refers to the properties of a cleaning composition relating to suds character during the dishwashing process. The term "sudsing profile" of a cleaning composition includes suds volume generated upon dissolving and agitation, typically manual agitation, of the cleaning composition in the aqueous washing solution, and the retention of the suds during the dishwashing process. Preferably, hand dishwashing cleaning compositions characterized as having "good sudsing profile" tend to have high suds volume and/or sustained suds volume, particularly during a substantial portion of or for the entire manual dishwashing process. This is important as the consumer uses high suds as an indicator that sufficient cleaning composition has been dosed. Moreover, the consumer also uses the sustained suds volume as an indicator that sufficient active cleaning ingredients (e.g., surfactants) are present, even towards the end of the dishwashing process. The consumer usually renews the washing solution when the sudsing subsides. Thus, a low sudsing cleaning composition will tend to be replaced by the consumer more frequently than is necessary because of the low sudsing level.

It is understood that the test methods that are disclosed in the Test Methods Section of the present application must be used to determine the respective values of the parameters of Applicants' inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Composition

The present invention relates to a liquid hand dishwashing cleaning compositions having a good sudsing profile, including high suds volume generation and/or sustained suds stabilization through-out a substantial portion of, or the entire dishwashing process. This signals to the user that there is still sufficient active ingredients present to provide good cleaning performance, as such triggering less re-dosing and overconsumption of the product by the user.

The Applicant has surprisingly found that by selecting a surfactant system with the defined degree of branching and branching split, sustained suds stabilization and/or high suds volume can be achieved. The results are unexpected since previous attempts to improve sudsing profile have not focused on the use of such branched anionic surfactant systems.

Furthermore, the compositions of the present invention present good stability due to the compatibility of the surfactant system with the remaining ingredients of the composition. The composition can also be aesthetically pleasant because the presence of the surfactant system does not alter the appearance of the composition, i.e., transparent, translucent, etc. The composition of the present invention can also provide good grease removal, in particular good uncooked grease removal, and/or particulate soil removal.

The cleaning composition is a hand dishwashing cleaning composition in liquid form. Preferably, the composition contains from 50% to 85%, preferably from 50% to 75%, by weight of the total composition of a liquid carrier in which the other essential and optional components are dissolved, dispersed or suspended. One preferred component of the liquid carrier is water.

Preferably, the pH of the composition is from about 6 to about 14, preferably from about 7 to about 12, or more preferably from about 7.5 to about 10, as measured at 10 dilution in distilled water at 20° C. The pH of the composition can be adjusted using pH modifying ingredients known in the art.

The composition of the present invention can be Newtonian or non-Newtonian, preferably Newtonian. Preferably, the composition has an initial viscosity of from 10 mPa·s to 10,000 mPa·s, preferably from 100 mPa·s to 5,000 mPa·s, more preferably from 300 mPa·s to 2,000 mPa·s, or most preferably from 500 mPa·s to 1,500 mPa·s, alternatively combinations thereof. Viscosity is measured with a Brookfield RT Viscometer using spindle 21 at 20 RPM at 25° C.

The cleaning composition of the invention is especially suitable for use as a hand dishwashing detergent. Due to its desirable sudsing profile, it is extremely suitable for use in diluted form in a full sink of water to wash dishes.

Surfactant System

The cleaning composition comprises from 1% to 60%, preferably from 5% to 50%, more preferably from 8% to 45%, most preferably from 15% to 40%, by weight of the total composition of a surfactant system comprising an anionic surfactant and a co-surfactant.

Anionic Surfactant

Preferably, the surfactant system for the cleaning composition of the present invention comprises from 60% to 90%, preferably from 65% to 85%, more preferably from 70% to 80%, by weight of the surfactant system of an anionic surfactant. The anionic surfactant comprises an alkyl sulfate, an alkyl alkoxy sulfate preferably an alkyl ethoxy sulfate, or mixtures thereof, preferably the alkyl sulfate, the alkyl alkoxy sulfate preferably the alkyl ethoxy sulfate, or mixtures thereof is a mixture of linear anionic surfactant and branched anionic surfactant. The preferred average alkyl chain length of the linear anionic surfactant is from 12 to 14 carbon atoms. Preferably, the surfactant system comprises from 60% to 80%, more preferably from 65% to 75%, by weight of the anionic surfactant of a linear anionic surfactant.

The branched anionic surfactant is selected from 5% to 100%, preferably from 5% to 75%, more preferably from 5% to 60%, even more preferably from 5% to 45%, most preferably from 5% to 30% by weight of the total branched anionic surfactant of a branched alkyl alkoxy sulfate preferably a branched alkyl ethoxy sulfate surfactant and from 0% to 95%, preferably from 75% to 95%, more preferably from 40% to 95%, even more preferably from 55% to 95%, most preferably from 70% to 95% by weight of the total branched anionic surfactant of a branched alkyl sulfate surfactant. This degree of branching and branching split contributes to enhanced suds longevity of the composition. It also contributes to the stability of the detergent. The preferred average alkyl chain length of the branched anionic surfactant is from 12 to 15, more preferably from 12 to 13 carbons. Preferably, the surfactant system comprises from 20% to 40%, more preferably from 25% to 35%, by weight of the anionic surfactant of a branched anionic surfactant.

Preferably, the composition of the present invention wherein no further anionic surfactant, other than the alkyl sulfate, the alkyl alkoxy sulfate preferably the alkyl ethoxy sulfate, or mixtures thereof, is added to the composition.

The weight average degree of branching of the anionic surfactant is from 27% to 34%, preferably from 29% to 32%. The weight average degree of branching for an anionic surfactant mixture is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, are the weight in grams of each alcohol in the total alcohol mixture of the alcohols which were used as starting material for the anionic surfactant for the detergent of the invention. In the weight average branching degree calculation, the weight of anionic surfactant components not having branched groups should also be included.

The average degree of ethoxylation of the anionic surfactant mixture is less than 5, preferably less than 3, more preferably less than 2 and more than 0.5, most preferably between 0.5 and 0.9. The average alkoxylation degree is the mol average alkoxylation degree of all the components of the mixture (i.e., mol average alkoxylation degree) of the anionic surfactant. In the mol average alkoxylation degree calculation the weight of sulfate anionic surfactant components not having alkoxylate groups should also be included.

$$\text{Mol average alkoxylation degree}=(x1*\text{alkoxylation degree of surfactant 1}+x2*\text{alkoxylation degree of surfactant 2}+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

To define the branching split between branched alkyl sulfate and branched alkyl ethoxy sulfate, the formulator will have to define this based on the formulated molecules within the final formulation rather than the added raw materials. A commercially available branched alkyl ethoxy sulfate raw material will comprise a mixture of linear alkyl sulfate, branched alkyl sulfate, linear alkyl ethoxy sulfate and branched alkyl ethoxy sulfate. Accordingly, the branched alkyl sulfate fraction will have to be considered to calculate the degree of branched alkyl sulfate by weight of the total branched anionic surfactant, while the branched alkyl ethoxy sulfate fraction will have to be considered to calculate the degree of branched alkyl ethoxy sulfate by weight of the total branched anionic surfactant in the final formulation. The actual calculation will have to be executed based on the starting alcohol and ethoxylated alcohols, rather than on the final sulfated materials, as explained in the weight average degree of branching calculation above.

Suitable counterions include alkali metal cation earth alkali metal cation, alkanolammonium or ammonium or substituted ammonium, but preferably sodium.

Suitable examples of commercially available sulfates include, those based on Neodol alcohols ex the Shell company, Lial-Isalchem and Safol® ex the Sasol company, natural alcohols ex The Procter & Gamble Chemicals company. The skilled person in the art can create mixtures of these starting materials to achieve the anionic surfactant composition according to the invention, considering the relative fractions of linear alkyl sulfate, linear alkyl ethoxy sulfate, branched alkyl sulfate and branched alkyl ethoxy sulfate, as obtained from the technical data sheets from the relative suppliers or analytically analyzed.

Preferably, the branched alkyl ethoxy sulfate surfactant of the present invention comprises at least 5%, more preferably at least 10%, by weight of the branched alkyl ethoxy sulfate surfactant of an alkyl ethoxy sulfate surfactant with the branching on the C2 position. Preferably, the branched alkyl ethoxy sulfate surfactant comprises at least 90%, more preferably 100%, by weight of the branched alkyl ethoxy sulfate surfactant of an alkyl ethoxy sulfate surfactant with the branching on the C2 position.

Preferably, the branched alkyl sulfate surfactant preferably comprises at least 5%, more preferably at least 10%, even more preferably at least 20%, most preferably at least 30%, by weight of the branched alkyl sulfate surfactant of a branched alkyl sulfate surfactant with the branching on the C2 position. Preferably, the branched alkyl sulfate surfactant comprises at least 90%, more preferably 100% by weight of the branched alkyl sulfate surfactant of a branched alkyl sulfate surfactant with the branching on the C2 position.

Preferably, the branched alkyl group of the branched anionic surfactant is predominantly, preferably greater than 75%, more preferably greater than 90%, of the total branched alkyl content, of a C1-C5 alkyl moiety, preferably a C1-C2 alkyl moiety.

Co-Surfactant

The surfactant system of the composition of the present invention comprises a co-surfactant. The composition preferably comprises from 0.1% to 20%, more preferably from 0.5% to 15% and especially from 2% to 10% by weight of the cleaning composition of the co-surfactant. Preferably, the surfactant system for the cleaning composition of the present invention comprises from 10% to 40%, preferably from 15% to 35%, more preferably from 20% to 30%, by weight of the surfactant system of a co-surfactant. The co-surfactant is selected from the group consisting of an amphoteric surfactant, a zwitterionic surfactant, and mixtures thereof.

The composition of the present invention will preferably comprise an amine oxide as the amphoteric surfactant. Preferably, the amine oxide surfactant is selected from the group consisting of a linear or branched alkyl amine oxide surfactant, a linear or branched alkyl amidopropyl amine oxide surfactant, and mixtures thereof, more preferably a linear alkyl dimethyl amine oxide surfactant, even more preferably a linear C10 alkyl dimethyl amine oxide surfactant, a linear C12-C14 alkyl dimethyl amine oxide surfactant, and mixtures thereof, most preferably a linear C12-C14 alkyl dimethyl amine oxide surfactant Preferably, the amine oxide surfactant is alkyl dimethyl amine oxide or alkyl amido propyl dimethyl amine oxide, preferably alkyl dimethyl amine oxide and especially coco dimethyl amino oxide, most preferably C12-C14 alkyl dimethyl amine oxide. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the α carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein. The amine oxide further comprises two moieties, independently selected from a C1-3 alkyl, a C1-3 hydroxyalkyl group, or a polyethylene oxide group containing an average of from about 1 to about 3 ethylene oxide groups. Preferably, the two moieties are selected from a C1-3 alkyl, more preferably both are selected as a C1 alkyl.

Alternatively, the amine oxide surfactant is a mixture of amine oxides comprising a low-cut amine oxide and a mid-cut amine oxide. The amine oxide of the composition of the invention then comprises:

a) from about 10% to about 45% by weight of the amine oxide of low-cut amine oxide of formula R1R2R3AO wherein R1 and R2 are independently selected from hydrogen, C1-C4 alkyls or mixtures thereof, and R3 is selected from C10 alkyls or mixtures thereof; and b) from 55% to 90% by weight of the amine oxide of mid-cut amine oxide of formula R4R5R6AO wherein R4 and R5 are independently selected from hydrogen, C1-C4 alkyls or mixtures thereof, and R6 is selected from C12-C16 alkyls or mixtures thereof In a preferred low-cut amine oxide for use herein R3 is n-decyl. In another preferred low-cut amine oxide for use herein R1 and R2 are both methyl. In an especially preferred low-cut amine oxide for use herein R1 and R2 are both methyl and R3 is n-decyl.

Preferably, the amine oxide comprises less than about 5%, more preferably less than 3%, by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Compositions comprising R7R8R9AO tend to be unstable and do not provide very suds mileage.

Preferably, the zwitterionic surfactant is a betaine surfactant. Suitable betaine surfactant includes alkyl betaines, alkylamidobetaine, amidazoliniumbetaine, sulfobetaine (INCI Sultaines) as well as the Phosphobetaine and preferably meets Formula (I):

$$R^1—[CO—X(CH_2)_n]_x—N^+(R^2)(R_3)—(CH_2)_m—[CH(OH)—CH_2]_y—Y— \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n is a number from 1 to 10, preferably 2 to 5, in particular 3, x is 0 or 1, preferably 1, R2 and R3 are independently a C1-4 alkyl residue, potentially hydroxy substituted such as a hydroxyethyl, preferably a methyl, m is a number from 1 to 4, in particular 1, 2 or 3, y is 0 or 1, and Y is COO, SO3, OPO(OR5)O or P(O)(OR5)O, whereby R5 is a hydrogen atom H or a C1-4 alkyl residue.

Preferred betaines are the alkyl betaines of the Formula (Ia), the alkyl amido propyl betaine of the Formula (Ib), the Sulfo betaines of the Formula (Ic) and the Amido sulfobetaine of the Formula (Id):

$$R^1—N(CH_3)_2—CH_2COO— \quad (Ia)$$

$$R^1—CO—NH(CH_2)_3—N^+(CH_3)_2—CH_2COO— \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which R1 as the same meaning as in Formula (I). Particularly preferred betaines are the Carbobetaine [wherein Y—=COO—], in particular the Carbobetaine of the Formulae (Ia) and (Ib), more preferred are the Alkylamidobetaine of the Formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, cocoamidopropylbetaine.

Non-Ionic Surfactant

Preferably, the surfactant system of the composition of the present invention further comprises from 1% to 25%, preferably from 1.25% to 20%, more preferably from 1.5% to 15%, most preferably from 1.5% to 5%, by weight of the surfactant system, of a non-ionic surfactant. Preferably, the non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol.

Alkyl Polyglucoside Surfactant

Preferably, the composition of the present invention further comprises from 0.5% to 20%, more preferably from 0.75% to 15%, more preferably from 1% to 10%, most preferably from 1% to 5% by weight of the surfactant system of alkyl polyglucoside ("APG") surfactant. Preferably the alkyl polyglucoside surfactant is a C8-C16 alkyl polyglucoside surfactant, preferably a C8-C14 alkyl polyglucoside surfactant, preferably with an average degree of polymerization of between 0.1 and 3, more preferably between 0.5 and 2.5, even more preferably between 1 and 2. Most preferably the alkyl polyglucoside surfactant has an average alkyl carbon chain length between 10 and 16, preferably between 10 and 14, most preferably between 12 and 14, with an average degree of polymerization of between 0.5 and 2.5 preferably between 1 and 2, most preferably between 1.2 and 1.6. C8-C16 alkyl polyglucosides are commercially available from several suppliers (e.g., Simusol® surfactants from Seppic Corporation; and Glucopon® 600 CSUP, Glucopon® 650 EC, Glucopon® 600 CSUP/MB, and Glucopon® 650 EC/MB, from BASF Corporation).

Preferably, when comprising alkyl polyglucoside surfactant, the composition of the present invention wherein composition comprises a surfactant system comprising:

i) from 70% to 80% by weight of the surfactant system of an alkoxy ethoxy sulfate surfactant;

ii) from 20% to 30% by weight of the surfactant system of an amine oxide surfactant; and iii) from 1% to 5% by weight of the surfactant system of an alkyl polyglucoside surfactant.

Amphiphilic Polymer

The composition of the present invention may further comprise from about 0.01% to about 5%, preferably from about 0.05% to about 2%, more preferably from about 0.07% to about 1% by weight of the total composition of an amphiphilic polymer selected from the groups consisting of amphiphilic alkoxylated polyalkyleneimine and mixtures thereof, preferably an amphiphilic alkoxylated polyalkyleneimine.

Preferably, the amphiphilic alkoxylated polyalkyleneimine is an alkoxylated polyethyleneimine polymer comprising a polyethyleneimine backbone having average molecular weight range from 100 to 5,000, preferably from 400 to 2,000, more preferably from 400 to 1,000 Daltons and the alkoxylated polyethyleneimine polymer further comprising:

(i) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or mixtures thereof;

(ii) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or mixtures thereof; or (iii) a combination thereof; and wherein the alkoxy moieties comprises ethoxy (EO) and/or propoxy (PO) and/or butoxy (BO) and wherein when the alkoxylation modification comprises EO it also comprises PO or BO.

Preferred amphiphilic alkoxylated polyethyleneimine polymers comprise EO and PO groups within their alkoxylation chains, the PO groups preferably being in terminal position of the alkoxy chains, and the alkoxylation chains preferably being hydrogen capped. Hydrophilic alkoxylated polyethyleneimine polymers solely comprising ethoxy (EO) units within the alkoxylation chain could also optionally be formulated within the scope of this invention.

For example, but not limited to, below is shown possible modifications to terminal nitrogen atoms in the polyethyleneimine backbone where R represents an ethylene spacer and E represents a C1-C4 alkyl moiety and X— represents a suitable water soluble counterion.

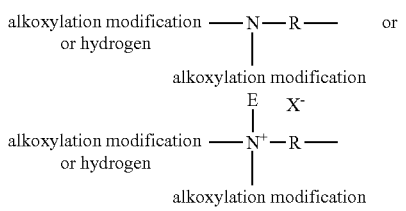

Also, for example, but not limited to, below is shown possible modifications to internal nitrogenatoms in the polyethyleneimine backbone where R represents an ethylene spacer and E represents a $C_1$-$C_4$ alkyl moiety and X— represents a suitable water soluble counterion.

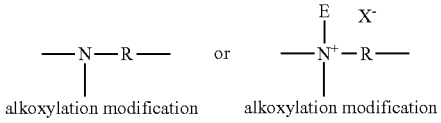

The alkoxylation modification of the polyethyleneimine backbone consists of the replacement of a hydrogen atom by a polyalkoxylene chain having an average of about 1 to about 50 alkoxy moieties, preferably from about 20 to about 45 alkoxy moieties, most preferably from about 30 to about 45 alkoxy moieties. The alkoxy moieties are selected from ethoxy (EO), propoxy (PO), butoxy (BO), and mixtures thereof. Alkoxy moieties solely comprising ethoxy units are outside the scope of the invention though. Preferably, the polyalkoxylene chain is selected from ethoxy/propoxy block moieties. More preferably, the polyalkoxylene chain is ethoxy/propoxy block moieties having an average degree of ethoxylation from about 3 to about 30 and an average degree of propoxylation from about 1 to about 20, more preferably ethoxy/propoxy block moieties having an average degree of ethoxylation from about 20 to about 30 and an average degree of propoxylation from about 10 to about 20.

More preferably the ethoxy/propoxy block moieties have a relative ethoxy to propoxy unit ratio between 3 to 1 and 1 to 1, preferably between 2 to 1 and 1 to 1. Most preferably the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized. Most preferably the degree of quaternization is about 0%.

A preferred polyethyleneimine has the general structure of Formula (II):

(II)

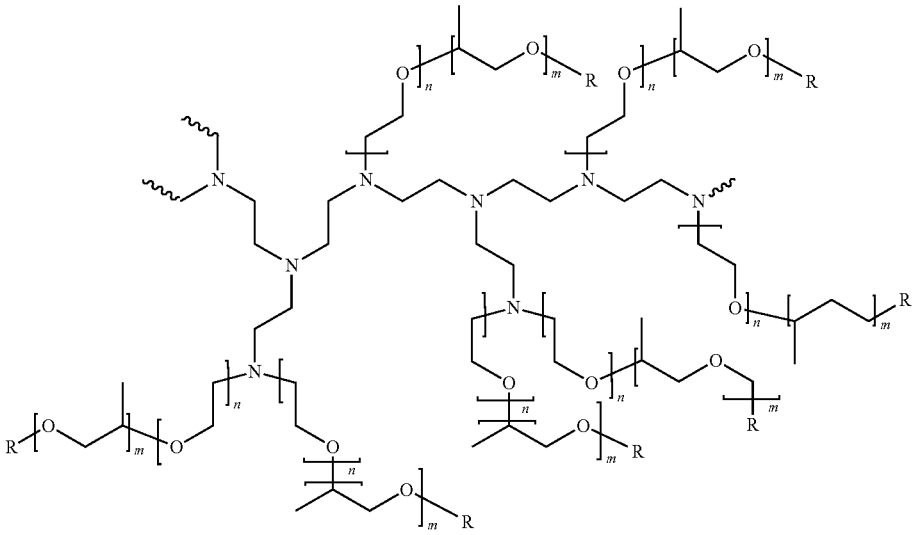

wherein the polyethyleneimine backbone has a weight average molecular weight of about 600, n of formula (II) has an average of about 10, m of formula (II) has an average of about 7 and R of formula (II) is selected from hydrogen, a $C_1$-$C_4$ alkyl and mixtures thereof, preferably hydrogen. The degree of permanent quaternization of formula (II) may be from 0% to about 22% of the polyethyleneimine backbone nitrogen atoms. The molecular weight of this polyethyleneimine preferably is between 10,000 and 15,000.

An alternative polyethyleneimine has the general structure of Formula (II) but wherein the polyethyleneimine backbone has a weight average molecular weight of about 600, n of Formula (II) has an average of about 24, m of Formula (II) has an average of about 16 and R of Formula (II) is selected from hydrogen, a $C_1$-$C_4$ alkyl and mixtures thereof, preferably hydrogen. The degree of permanent quaternization of Formula (II) may be from 0% to about 22% of the polyethyleneimine backbone nitrogen atoms. The molecular weight of this polyethyleneimine preferably is between 25,000 and 30,000.

Most preferred polyethyleneimine has the general structure of Formula (II) wherein the polyethyleneimine backbone has a weight average molecular weight of about 600, n of Formula (II) has an average of about 24, m of Formula (II) has an average of about 16 and R of Formula (II) is hydrogen. The degree of permanent quaternization of Formula (II) is 0% of the polyethyleneimine backbone nitrogen atoms. The molecular weight of this polyethyleneimine preferably is about from about 25,000 to 30,000, most preferably about 28,000.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, as described in more detail in PCT Publication No. WO 2007/135645.

Cyclic Polyamine

The cyclic polyamine of the invention is a cleaning polyamine. The cleaning polyamine comprises amine functionalities that helps cleaning as part of a cleaning composition. The composition of the invention preferably comprises from about 0.1% to about 10%, more preferably from about 0.2% to about 5%, and especially from about 0.3% to about 2%, by weight of the composition, of the cyclic polyamine.

The term "cyclic amine" herein encompasses a single amine and a mixture thereof. The amine can be subjected to protonation depending on the pH of the cleaning medium in which it is used. The cyclic polyamine of the invention conforms to the following Formula (I):

(I)

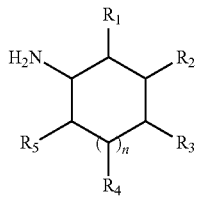

wherein $R_1$, $R_2$, $R_3$, $R_4$ and $R_5$ are independently selected from the group consisting of NH2, —H, linear or branched alkyl having from 1 to 10 carbon atoms, and linear or branched alkenyl having from 1 to 10 carbon atoms, n is from 0 to 3, preferably n is 1, and wherein at least one of the Rs is NH2 and the remaining "Rs" are independently selected from the group consisting of NH2, —H, linear or branched alkyl having 1 to 10 carbon atoms, and linear or branched alkenyl having from 1 to 10 carbon atoms. Preferably, the cyclic polyamine is a diamine, wherein n is 1, $R_2$ is NH2, and at least one of $R_1$, $R_3$, $R_4$ and $R_5$ is CH3 and the remaining Rs are H.

The amine of the invention is a cyclic amine with at least two primary amine functionalities. The primary amines can be in any position in the cyclic amine but it has been found that in terms of grease cleaning, better performance is obtained when the primary amines are in positions 1,3. It has also been found that cyclic amines in which one of the substituents is —CH3 and the rest are H provided for improved grease cleaning performance.

Accordingly, the most preferred cyclic polyamine for use with the cleaning composition of the present invention are cyclic polyamine selected from the group consisting of 2-methylcyclohexane-1,3-diamine, 4-methylcyclohexane-1,3-diamine and mixtures thereof. The inventors have surprisingly found that these specific cyclic polyamine works to improve suds profile through-out the dishwashing process when formulated together with the specific surfactant system according to the present invention.

The composition of the present invention may comprise at least one active selected from the group consisting of: i) a salt, ii) a hydrotrope, iii) an organic solvent, and mixtures thereof.

Salt

The composition of the present invention may comprise from about 0.05% to about 2%, preferably from about 0.1% to about 1.5%, or more preferably from about 0.5% to about 1%, by weight of the total composition of a salt, preferably a monovalent, divalent inorganic salt or a mixture thereof, more preferably sodium chloride, sodium sulfate or a mixture thereof, most preferably sodium chloride.

Hydrotrope

The composition of the present invention may comprise from about 0.1% to about 10%, or preferably from about 0.5% to about 10%, or more preferably from about 1% to about 10% by weight of the total composition of a hydrotrope or a mixture thereof, preferably sodium cumene sulfonate.

Organic Solvent

The composition of the present invention may comprise an organic solvent. Suitable organic solvents include C4-14 ethers and diethers, polyols, glycols, alkoxylated glycols, C6-C16 glycol ethers, alkoxylated aromatic alcohols, aromatic alcohols, aliphatic linear or branched alcohols, alkoxylated aliphatic linear or branched alcohols, alkoxylated C1-05 alcohols, C8-C14 alkyl and cycloalkyl hydrocarbons and halohydrocarbons, and mixtures thereof. Preferably the organic solvents include alcohols, glycols, and glycol ethers, alternatively alcohols and glycols. The composition comprises from 0% to less than about 50%, preferably from about 0.01% to about 25%, more preferably from about 0.1% to about 10%, or most preferably from about 0.5% to about 5%, by weight of the total composition of an organic solvent, preferably an alcohol, more preferably ethanol, a polyalkyleneglycol, more preferably polypropyleneglycol, and mixtures thereof.

Adjunct Ingredients

The cleaning composition herein may optionally comprise a number of other adjunct ingredients such as builders (e.g., preferably citrate), chelants, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

The elements of the composition of the invention described in connexion with the first aspect of the invention apply mutatis mutandis to the other aspects of the invention.

Method of Washing

In another aspect, the invention is directed to a method of manually washing dishware with the composition of the present invention. The method comprises the steps of delivering a composition of the present invention to a volume of water to form a wash solution and immersing the dishware in the solution. The dishware can be cleaned with the composition in the presence of water. Optionally, the dishware can be rinsed. By "rinsing", it is meant herein contacting the dishware cleaned with the process according to the present invention with substantial quantities of appropriate solvent, typically water. By "substantial quantities", it is meant usually about 1 to about 20 L.

The composition herein can be applied in its diluted form. Soiled dishware are contacted with an effective amount, typically from about 0.5 mL to about 20 mL (per about 25 dishes being treated), preferably from about 3 mL to about 10 mL, of the cleaning composition, preferably in liquid form, of the present invention diluted in water. The actual amount of cleaning composition used will be based on the judgment of the user, and will typically depend upon factors such as the particular product formulation of the cleaning composition, including the concentration of active ingredients in the cleaning composition, the number of soiled dishes to be cleaned, the degree of soiling on the dishes, and the like. Generally, from about 0.01 mL to about 150 mL, preferably from about 3 mL to about 40 mL of a cleaning composition of the invention is combined with from about 2,000 mL to about 20,000 mL, more typically from about 5,000 mL to about 15,000 mL of water in a sink having a volumetric capacity in the range of from about 1,000 mL to about 20,000 mL, more typically from about 5,000 mL to about 15,000 mL. The soiled dishware are immersed in the sink containing the diluted cleaning compositions then obtained, where contacting the soiled surface of the dishware with a cloth, sponge, or similar cleaning implement cleans them. The cloth, sponge, or similar cleaning implement may be immersed in the cleaning composition and water mixture prior to being contacted with the dishware, and is typically contacted with the dishware for a period of time ranged from about 1 to about 10 seconds, although the actual time will vary with each application and user. The contacting of cloth, sponge, or similar cleaning implement to the dishware is preferably accompanied by a concurrent scrubbing of the dishware.

Another aspect of the present invention is directed to use of a hand dishwashing cleaning composition of the present invention for providing good sudsing profile, including suds stabilization in the presence of greasy and/or particulate soils.

TEST METHODS

The following assays set forth must be used in order that the invention described and claimed herein may be more fully understood.

Test Method 1: Suds Mileage Test

The objective of the Suds Mileage Test is to compare the evolution over time of suds volume generated for different test formulations at specified water hardness, solution temperatures and formulation concentrations, while under the influence of periodic soil injections. Data are compared and expressed versus a reference composition as a suds mileage index (reference composition has suds mileage index of 100). The steps of the method are as follows:

1. A defined amount of a test composition, depending on the targeted composition concentration (here: 0.24 wt %), is dispensed through a plastic pipette at a flow rate of 0.67 mL/sec at a height of 37 cm above the bottom surface of a sink (dimension: 300 mm diameter and 288 mm height) into a water stream (here: water hardness: 15 gpg, water temperature: 35° C.) that is filling up the sink to 4 L with a constant pressure of 4 bar.
2. An initial suds volume generated (measured as average foam height X sink surface area and expressed in $cm^3$) is recorded immediately after end of filling.
3. A fixed amount (6 mL) of a soil with defined composition as below is immediately injected into the middle of the sink.
4. The resultant solution is mixed with a metal blade (10 cm×5 cm) positioned in the middle of the sink at the air liquid interface under an angle of 45 degrees rotating at 85 RPM for 20 revolutions.
5. Another measurement of the total suds volume is recorded immediately after end of blade rotation.
6. Steps 3-5 are repeated until the measured total suds volume reaches a minimum level of 400 $cm^3$. The amount of added soil that is needed to get to the 400 $cm^3$ level is considered as the suds mileage for the test composition.
7. Each test composition is tested 4 times per testing condition (i.e., water temperature, composition concentration, water hardness, soil type).
8. The average suds mileage is calculated as the average of the 4 replicates for each sample for a defined test condition.
9. Calculate a Suds Mileage Index by comparing the average mileage of a test composition sample versus a reference composition sample. The calculation is as follows:

$$\text{Suds Mileage Index} = \frac{\text{Average number of soil additions of test composition}}{\text{Average of number of soil additions of reference composition}} \times 100$$

Soil compositions are produced through standard mixing of the components described in Tables 1 and 2.

TABLE 1

| Greasy Soil | |
|---|---|
| Ingredient | Weight % |
| Crisco Oil | 12.730 |
| Crisco shortening | 27.752 |
| Lard | 7.638 |
| Refined Rendered Edible Beef Tallow | 51.684 |
| Oleic Acid, 90% (Techn) | 0.139 |
| Palmitic Acid, 99+% | 0.036 |
| Stearic Acid, 99+% | 0.021 |

TABLE 2

| Particulate Soil | |
|---|---|
| Ingredient | Weight % |
| Zwan Flemish Carbonades | 22.67 |
| Beaten Eggs | 4.78 |
| Smash Instant Mash Potato | 9.26 |
| McDougall's Sponge Mix | 3.30 |
| Milk UHT Full Cream | 22.22 |
| Bisto Gravy Granules | 1.30 |
| Mazola ® Pure Corn Oil | 9.29 |
| Demineralized water | 26.32 |
| Sodium Benzoate | 0.42 |
| Potassium Sorbate | 0.42 |

EXAMPLE

The following examples are provided to further illustrate the present invention and are not to be construed as limitations of the present invention, as many variations of the present invention are possible without departing from its spirit or scope.

Example 1: Inventive and Comparative Compositions

The ability of cleaning compositions to maintain their suds mileage is assessed for cleaning compositions having an average degree of branching (30%) and a branched AES over branched AS ratio (51/49; 17/83; 8/92) according to the invention (Inventive Compositions 1-3, respectively). In parallel, Comparative Composition 1 having a branched AES over branched AS ratio (0/100, 30% average degree of branching or Comparative Composition 2 having an average degree of branching (45%, 18/82-branched AES over branched AS-ratio) outside the scope of the present invention are also assessed. The foregoing compositions are produced through standard mixing of the components described in Table 3.

TABLE 3

Inventive and Comparative Compositions

| | Inventive Comp. 1 | Inventive Comp. 2 | Inventive Comp. 3 | Comparative Comp. 1 | Comparative Comp. 2 |
|---|---|---|---|---|---|
| AE0.6S | 14.35% | 14.35% | 14.35% | 14.35% | 14.35% |
| C12-14 Dimethyl Amine Oxide | 3.59% | 3.59% | 3.59% | 3.59% | 3.59% |
| NaCl | 0.70% | 0.70% | 0.70% | 0.70% | 0.70% |
| Polypropylene Glycol (MW 2000) | 0.70% | 0.70% | 0.70% | 0.70% | 0.70% |
| Ethanol | 2.00% | 2.00% | 2.00% | 2.00% | 2.00% |
| Sodium Citrate | 0.50% | 0.50% | 0.50% | 0.50% | 0.50% |
| HC1 (pH adjust) | To pH = 9.0 | To pH = 9.0 | To pH = 9.0 | To pH = 9.0 | To pH = 9.0 |
| Water + Minor ingredients (perfume, dye, preservatives | Balance to 100% | Balance to 100% | Balance to 100% | Balance to 100% | Balance to 100% |
| pH (at 10% product concentration in demineralized water) | 9.04 | 9.01 | 8.95 | 9.02 | 8.97 |
| AES: starting alcohol blend composition | 8.3% Natural AE3<br>8.4% Neodol 23 AE2<br>19.1% Isalchem 123 AE2<br>20.7% Natural A<br>40.7% Neodol 23 A<br>2.8% Isalchem 123 | 18.8% Natural AE3<br>8.4% Neodol 23 AE2<br>5.5% Isalchem 123 AE2<br>3.5% Natural A<br>48.4% Neodol 23 A<br>15.4% Isalchem 123 | 16.5% Natural AE3<br>16.7% Neodol 23 AE2<br>40.0% Lial 123 A<br>26.8% Neodol 23 A | 29.6% Natural AE3<br>16.0% Natural A<br>54.4% Lial 123A | 21.0% Natural Ae3<br>11.0% Isalchem 123 AE2<br>7.0% Natural A<br>30.0% Neodol 23 A<br>31.0% Isalchem 123 |
| Avg. degree of branching | 30% | 30% | 30% | 30% | 45% |
| Branched AES-Branched AS ratio | 51/49 | 17/83 | 8/92 | 0/100 | 18/82 |

Example 1a: Suds Mileage Index of Inventive and Comparative Compositions

The resultant compositions including the Inventive Compositions 1-3 and Comparative Compositions 1-2 are assessed according to the Suds Mileage Index test method as described herein. The Suds Mileage Index results of the test are summarized in Table 4. The higher the Suds Mileage Index value, the better in maintaining suds mileage. From the data it can be concluded that the Inventive Compositions 1-3 according to the invention have a stronger suds robustness in presence of greasy and particulate soils as compared to Comparative Compositions 1-2 outside the scope of the invention.

TABLE 4

Suds Mileage Index Results of Inventive and Comparative Compositions

| | Inventive Comp. 1 | Inventive Comp. 2 | Inventive Comp. 3 | Comparative Comp. 1 | Comparative Comp. 2 |
|---|---|---|---|---|---|
| Avg. degree of branching | 30% | 30% | 30% | 30% | 45% |

TABLE 4-continued

Suds Mileage Index Results of Inventive and Comparative Compositions

| | Inventive Comp. 1 | Inventive Comp. 2 | Inventive Comp. 3 | Comparative Comp. 1 | Comparative Comp. 2 |
|---|---|---|---|---|---|
| Branched AES-Branched AS ratio | 51/49 | 17/82 | 8/93 | 0/100 | 18/82 |
| Suds Mileage Index (Particulate soil) | 102 | 104 | 110 | 100 | — |

TABLE 4-continued

Suds Mileage Index Results of Inventive and Comparative Compositions

| | Inventive Comp. 1 | Inventive Comp. 2 | Inventive Comp. 3 | Comparative Comp. 1 | Comparative Comp. 2 |
|---|---|---|---|---|---|
| Suds Mileage Index (Greasy soil) | — | 104 | — | — | 100 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hand dishwashing cleaning composition comprising:

A) from about 1% to about 60% by weight of the total composition of a surfactant system comprising an anionic surfactant and a co-surfactant, wherein:

i) the average alkyl chain length of the anionic surfactant is from about 8 to about 18 carbon atoms;

ii) the anionic surfactant has a weight average degree of branching of from about 27% to about 34%, and an average degree of ethoxylation of less than about 5;

iii) at least one anionic surfactant consists of a mixture of linear alkyl sulfate, branched alkyl sulfate, linear alkyl ethoxy sulfate, and branched alkyl ethoxy sulfate, wherein from about 5% to about 45% by weight of the branched alkyl sulfate and branched alkyl ethoxy sulfate is branched alkyl ethoxy sulfate and from about 55% to about 95% by weight of the branched alkyl sulfate and branched alkyl ethoxy sulfate is branched alkyl sulfate; and iv) at least one co-surfactant has the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl, wherein at least one co-surfactant is present in an amount from 10% to 40% by weight of the surfactant system;

wherein the weight ratio of the anionic surfactant to the co-surfactant is from about 1:1 to about 8:1.

2. The composition according to claim 1, wherein i) the average alkyl chain length of the anionic surfactant is from about 10 to about 14 carbon atoms;

ii) the anionic surfactant has a weight average degree of branching of from about 29% to about 32% and an average degree of ethoxylation of less than about 3.

3. The composition according to claim 2, wherein i) the average alkyl chain length of the anionic surfactant is from about 12 to about 14 carbon atoms;

ii) the anionic surfactant has an average degree of ethoxylation of less than about 2 and more than about 0.5.

4. The composition according to claim 1, wherein from about 5% to about 30% by weight of the branched alkyl sulfate and branched alkyl ethoxy sulfate is branched alkyl ethoxy sulfate and from about 70% to about 95% by weight of the branched alkyl sulfate and branched alkyl ethoxy sulfate is branched alkyl sulfate.

5. The composition according to claim 1, wherein the branched alkyl ethoxy sulfate surfactant comprises at least about 5% by weight of the branched alkyl ethoxy sulfate surfactant of an alkyl ethoxy sulfate surfactant with the branching on the C2 position.

6. The composition according to claim 1, wherein the branched alkyl sulfate surfactant comprises at least about 5% by weight of the branched alkyl sulfate surfactant of a branched alkyl sulfate surfactant with the branching on the C2 position.

7. The composition according to claim 1, wherein the branching group on the branched alkyl sulfate and the branched alkyl ethoxy sulfate is greater than about 75% by weight of the total branched alkyl content, of a C1-C5 alkyl moiety.

8. The composition according to claim 7, wherein the branching group on the branched alkyl sulfate and the branched alkyl ethoxy sulfate is greater than about 90% by weight of the total branched alkyl content of a C1-C2 alkyl moiety.

9. The composition according to claim 1, wherein no further anionic surfactant, other than the mixture of linear alkyl sulfate, branched alkyl sulfate, linear alkyl ethoxy sulfate, and branched alkyl ethoxy sulfate, is added to the composition.

10. The composition according to claim 1, wherein the at least one co-surfactant comprises a linear C10 alkyl dimethyl amine oxide surfactant, a linear C12-C14 alkyl dimethyl amine oxide surfactant, or mixtures thereof.

11. The composition according to claim 1, further comprising from about 1% to about 25% by weight of the surfactant system of a non-ionic surfactant comprising on average from about 9 to about 15 carbon atoms in its alkyl chain and on average from about 5 to about 12 units of ethylene oxide per mole of alcohol.

12. The composition according to claim 1, further comprising from about 0.5% to about 20% by weight of the surfactant system of an alkyl polyglucoside surfactant, wherein the alkyl polyglucoside surfactant is a C8-C16 alkyl polyglucoside surfactant with an average degree of polymerization of between about 0.1 and about 3.

13. The composition according to claim 1, further comprising from about 0.05% to about 2% by weight of the total composition of an amphiphilic alkoxylated polyalkyleneimine or a mixture thereof, wherein the amphiphilic alkoxylated polyalkyleneimine is an alkoxylated polyethyleneimine polymer comprising a polyethyleneimine backbone having average molecular weight range of from about 100 to about 5,000 Daltons and the alkoxylated polyethyleneimine polymer further comprising:

i) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or a mixture thereof;

ii) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or a mixture thereof; or iii) a combination thereof; and wherein the alkoxy moieties comprises ethoxy (EO) and/or propoxy (PO) and/or butoxy (BO) and wherein when the alkoxylation modification comprises EO it also comprises PO or BO.

14. The composition according to claim 1, further comprising a cyclic polyamine of Formula (I):

(I)

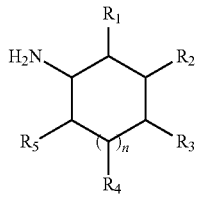

wherein $R_1$, $R_2$, $R_3$, $R_4$ and $R_5$ are independently selected from the group consisting of NH2, —H, linear or branched alkyl having from 1 to 10 carbon atoms, and linear or branched alkenyl having from 1 to 10 carbon atoms, n is from 0 to 3, and wherein at least one of the Rs is NH2 and the remaining Rs are independently selected from the group consisting of NH2, —H, linear or branched alkyl having 1 to 10 carbon atoms, and linear or branched alkenyl having from 1 to 10 carbon atoms.

15. The composition according to claim 1, further comprising at least one active selected from the group consisting of:

(i) from about 0.05% to about 2% by weight of the total composition of a salt selected from a monovalent inorganic salt, a divalent inorganic salt or a mixture thereof;

(ii) from about 1% to about 10% by weight of the total composition of a hydrotrope;

(iii) from about 0.01% to about 25% by weight of the total composition of an organic solvent; and (iv) mixtures thereof.

16. The composition according to claim 1, wherein the composition has an initial viscosity of from about 300 mPa·s to about 2,000 mPa·s as measured on a Brookfield RVT Viscometer using spindle 21 at 20 RPM at 25° C.

17. A hand dishwashing cleaning composition comprising:

A) from about 15% to about 40% by weight of the total composition of a surfactant system comprising an anionic surfactant, and an amine oxide co-surfactant, wherein:

i) the anionic surfactant has a weight average degree of branching of from about 29% to about 32% and an average degree of ethoxylation of between about 0.5 and about 0.9;

ii) the anionic surfactant and amine oxide co-surfactant are in weight ratio of between about 2.5:1 and about 4:1;

iii) at least one anionic surfactant consists of a mixture of linear alkyl sulfate, branched alkyl sulfate, linear alkyl ethoxy sulfate, and branched alkyl ethoxy sulfate, wherein from about 5% to about 30% by weight of the branched alkyl sulfate and branched alkyl ethoxy sulfate is branched alkyl ethoxy sulfate and from about 70% to about 95% by weight of the branched alkyl sulfate and branched alkyl ethoxy sulfate is branched alkyl sulfate; and iv) the amine oxide co-surfactant has the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl, wherein the amine oxide surfactant is present in an amount from 10% to 40% by weight of the surfactant system.

18. A method of manually washing dishware comprising the steps of: delivering a composition according to claim 1 to a volume of water to form a wash solution, and immersing the dishware in the solution.

19. The composition according to claim 17, wherein the composition has an initial viscosity of from about 300 mPa·s to about 2,000 mPa·s as measured on a Brookfield RVT Viscometer using spindle 21 at 20 RPM at 25° C.

* * * * *